US006435085B1

(12) United States Patent
York

(10) Patent No.: US 6,435,085 B1
(45) Date of Patent: Aug. 20, 2002

(54) PRINT SCREEN FRAME ASSEMBLY AND METHOD OF MAKING

(76) Inventor: James A. York, 1637 Garnet La., Concord, CA (US) 94519

( * ) Notice: Subject to any disclaimer, the term of this patent is extended or adjusted under 35 U.S.C. 154(b) by 0 days.

(21) Appl. No.: 09/494,215

(22) Filed: Jan. 28, 2000

Related U.S. Application Data

(60) Provisional application No. 60/117,839, filed on Jan. 29, 1999.

(51) Int. Cl.[7] ..... B41F 15/36

(52) U.S. Cl. ..... 101/127.1; 101/128.1

(58) Field of Search ..... 101/114, 127, 101/127.1, 128, 128.1, 129; 38/102.1, 102.2, 102.91, 102.8; 160/372, 374.1, 377, 378, 380, 381

(56) References Cited

U.S. PATENT DOCUMENTS 1,561,534 A * 11/1925 Gray ..... 101/127.1
4,223,602 A * 9/1980 Mitter ..... 101/129
4,452,138 A * 6/1984 Bubley et al. ..... 101/127.1
4,658,522 A * 4/1987 Kramer ..... 38/102.91
4,702,783 A * 10/1987 Mason, III ..... 101/127.1
5,520,223 A * 5/1996 Iorio et al. ..... 138/140
5,598,776 A * 2/1997 Casl ..... 101/127.1
5,622,108 A * 4/1997 Benedetto et al. ..... 101/127.1

* cited by examiner

*Primary Examiner*—Leslie J. Evanisko

(57) ABSTRACT

A print screen frame assembly used in the textile screen print industry. The frame assembly is formed of electrical conduit comprised of a rigid metallic conduit material which is coated to resist solvents, dyes and other chemicals commonly used in the print screen industry. The frame member is comprised of bendable, durable conduit material formed into a desired shape and secured at a seam to form a unitary frame member. On the top side of the frame member, a taut fabric print screen is attached by an adhesive. At least one spacer with a flat bottom edge is placed on the bottom of the tubular frame member allowing print screens to be easily used in printing presses and to permit frames to be stacked on top of one another for storage purposes.

25 Claims, 6 Drawing Sheets

PRINT SCREEN FRAME ASSEMBLY AND METHOD OF MAKING

This application claims the benefit of U.S. Provisional Application No. 60/117,839 filed on Jan. 29, 1999.

BACKGROUND OF THE INVENTION

The device and method of the present invention relate to a frame assembly that is constructed and arranged for use in screen printing operations. Particularly, this invention relates to a method of constructing a frame assembly to which a taut screen is attached for use in textile screen printing presses. More particularly this invention relates to the use of known electrical conduit for purposes of making print screen frame assemblies.

The electrical conduit formed frame assembly of the invention is comprised of coated metal conduit that is formed into a predetermined shape or frame configuration. The method of manufacturing the printing frame assembly includes providing at least one length of electrical conduit, bending the conduit to form a planar enclosure and joining the conduit by means of at least one insert. Attached to the electrical conduit or coated metallic frame can be at least one spacer used for mounting the frame to a printing press and for stacking the frames for storage purposes. The spacers may be coded for identifying the frames from one another.

In the past, print screen frames have generally been found to either lack durability or to be expensive. Prior art frames have been found to easily warp, to bow, or to separate at the corners during use, for example. Prior art frames are typically constructed of wood or other non-durable materials. Such prior art frames are heavy, easily breakable, difficult to transport by hand, awkward to store, and expensive. And although metal and aluminum frames have been used in the screen print industry, these frames have been relatively expensive to make and use and are generally complex in structure. These shortcomings of commonly used print screen frames slow printing operations and cost the print screen industry time and financial resources.

The frame assembly and method of the present invention overcome the difficulties and shortcomings of prior art print screen frame assemblies by providing a lightweight, durable and inexpensive print screen frame. Electrical conduit has been used for many years in many industrial environments to protect electrical wires and cables. Electrical conduit because of its wide use is inexpensive and readily available. This invention provides a new use for this known material.

The frame structure of this invention is rigid and constructed of a strong, lightweight metal material which allows easy transportation, movement, and manipulation of the frame assembly. The frame is constructed of zinc coated metal tube material which is resistant to warping and structural weakness during prolonged printing use. The frame structure is comprised of a formed tubular conduit, coupled or welded together at each seam to form a unitary frame member.

The frame assembly further can have at least one spacer attached to the tubular frame member which allow frames to be stacked on one another and to be placed into a printing press, and which are preferably coded to identify particular frame members. For example, various spacer colors or other identifying codes may be used to identify mesh count of the screen fastened to the frame. The stacking of frames saves space and allow the print screens to dry after use. Preferably, at least one spacer is attached to the metal frame and may be detached when necessary. Each spacer has a flat bottom surface for secure placement in a press and for stacking purposes in storage. The spacers are configured to have a predetermined height for purposes of use with specified printing presses.

SUMMARY OF THE INVENTION

The frame assembly of the present invention comprises a frame constructed and arranged for use in textile print screen operations. The frame assembly is formed of electrical conduit which is readily available in a variety of lengths and diameters. The electrical conduit of the frame structure is rigid and generally constructed of a lightweight, zinc coated tubular metal material or the like. A length of tubular conduit material is formed into a desired shape and the ends of the conduit are then joined by means of an internal pressure fitting or welded or otherwise coupled together to form a unitary frame member. The frame structure may be formed of one, two or more lengths of conduit. Typically, the frame members are rectangular in structure and have rounded corners.

On one side of the frame, a taut print screen fabric is stretched and secured to the frame by means of an adhesive bond, for example. Also attached to the bottom side of the frame can be at least one spacer. After a printing screen frame has been used in a printing press, the frame assembly can rest on the floor or be stacked onto another frame assembly without contacting its fabric screen portion. Each spacer has an inner surface that conforms in shape and size to the outer surface of the frame and grips the frame conduit outer surface when snapped onto the frame. The bottom outer surface of the spacer is flat so that a frame assembly securely rests on the ground or on top of another frame assembly. This invention further relates to various printing frame structures, frame compositions, coatings, frame configurations and methods to form the frame structures.

An object of this invention is to provide an affordable and durable frame for textile screen printers. The method of manufacturing the enclosed printing frame assembly utilizes at least one length of electrical conduit, whereby the electrical conduit is bent so that the one or more lengths form a generally planar enclosure. The ends are then aligned and joined and a print screen fabric is stretched over and adhered to the frame. The frame assembly is not intended to be restretched. The frame structure can be comprised of metallic, zinc coated conduit which is resistant to warping and bowing. The frame assembly can have at least one spacer and is adapted for use in textile printing presses.

These and other benefits of this invention will become clear from the following description by reference to the drawings.

DESCRIPTION OF THE PREFERRED EMBODIMENTS

Figure 1:
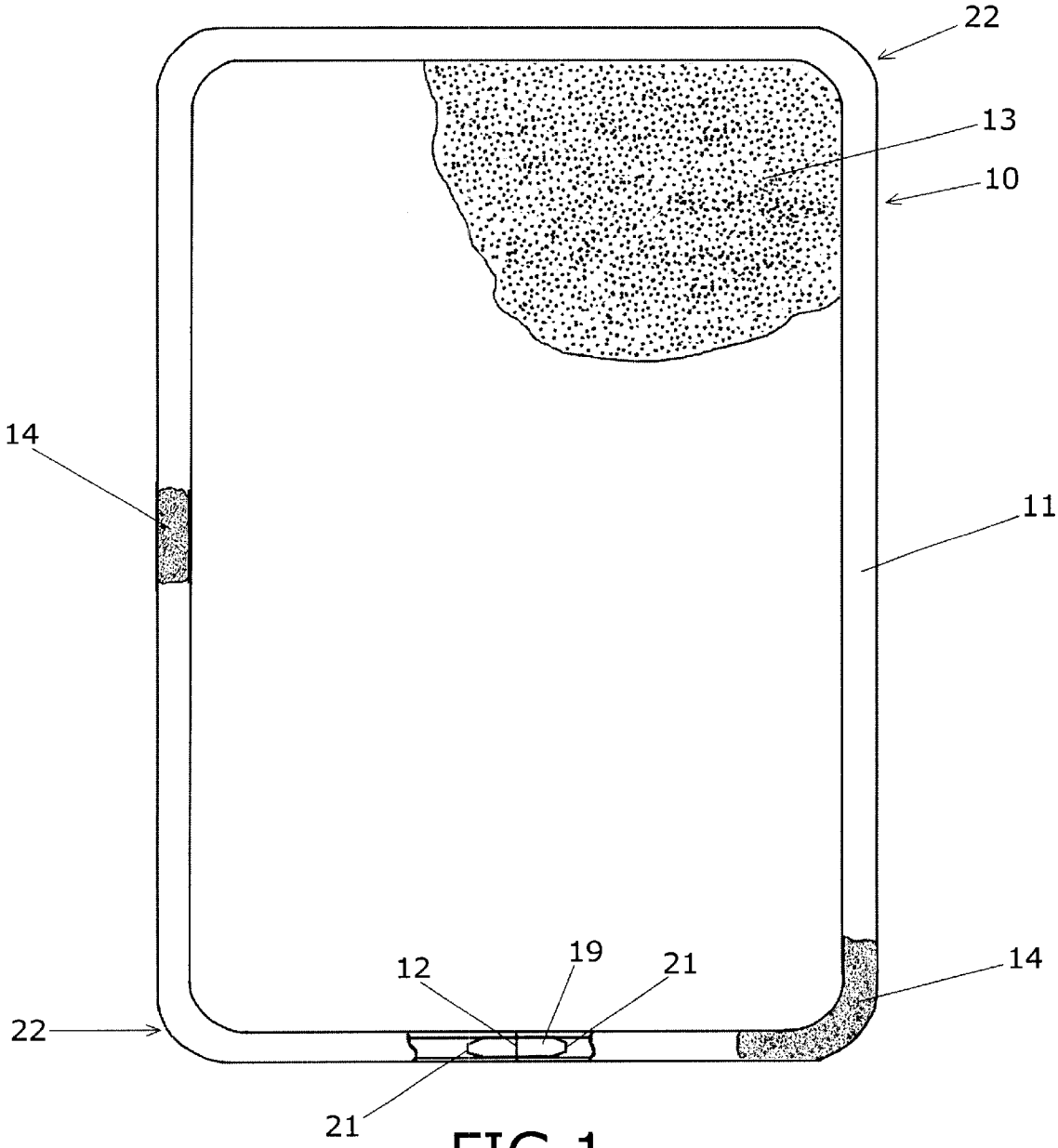
FIG. 1 is a top plan view showing the printing frame member of the present invention.

This invention relates to a print screen frame assembly and method. Particularly, the invention relates to the use of electrical conduit in manufacturing print screen frames.

Referring to FIGS. 1–5, the printing screen frame assembly 10 of the present invention is shown. The frame assembly 10 is constructed and arranged for use in screen printing operations. The frame assembly 10 is shown to have a taut fabric print screen 13 secured thereto. The print screen 13 is shown having a print image 18. The frame assembly 10 has a frame 11 comprised of a coated metal, tubular conduit molded into a predetermined shape, such as a rectangular shape having rounded corners 22. Shown attached to the bottom of frame 11 are spacers 15 which may be molded of a plastic or formed of wood, and which are used for securing the frame member 11 in a print machine and for stacking the frame assemblies 10 subsequent use in the printing press.

The frame 11 is constructed of electrical conduit which is a rigid, lightweight, and generally zinc coated metallic material. A zinc coated, carbon steel or like metal composition is particularly useful for screen printing operations in that it is resistant to the solvents, dyes and other chemicals commonly used in print screen operations and which securely holds a taut screen fabric material 13 when secured to the frame with an adhesive 14, such as a cyanoacrylate or like adhesive composition. To form the frame member 11, a length of tubular conduit is formed into a desired shape so that the ends of the conduit meet and align with each other, and the ends of the conduit are secured by an insert or welded or otherwise coupled together at joint or seam 12 to form a unitary frame member. Preferably, an insert 19 is pushed into the conduit ends to thereby connect and hold together the frame ends and to provide added strength to the frame structure.

Specifically, FIG. 1 shows the unitary frame member 11 formed in a generally rectangular shape. The unitary frame member 11 is comprised of a tubular metal conduit which is coated and which has a circular cross-section. For use in print screen operations, a taut sheet of screen fabric 13 is secured to one side of the peripheral outer surface of frame 11 so that it stretches over the opening formed by the frame.

Frames for example may be 19 inches×22 inches for manual press frames and 23 inches×31 inches for automatic press frames. The frame structure is further shown to have rounded corners 22. For example, a 2½ to 3 inch corner radius has been found well suited for the frames of this invention to provide at least 25 Newtons of screen tension at the frame corners.

A ¾ inch electrical conduit having a 0.922 inch OD has been found well suited for purposes of most frames whereas a one inch conduit is well suited for larger frames. The electrical conduit is preferably of a carbon steel construction having a galvanized coating. For example, EMT (electric metallic tubing) with a zinc coating, or the like, is suitable for the frame structure according to the teachings of the present invention.

Figure 2:
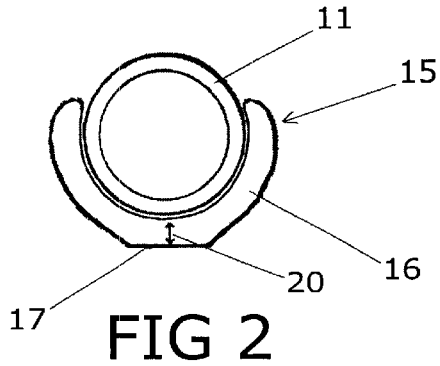
FIG. 2 is a cross-sectional view showing a spacer attached to the frame of FIG. 1.
Figure 3:
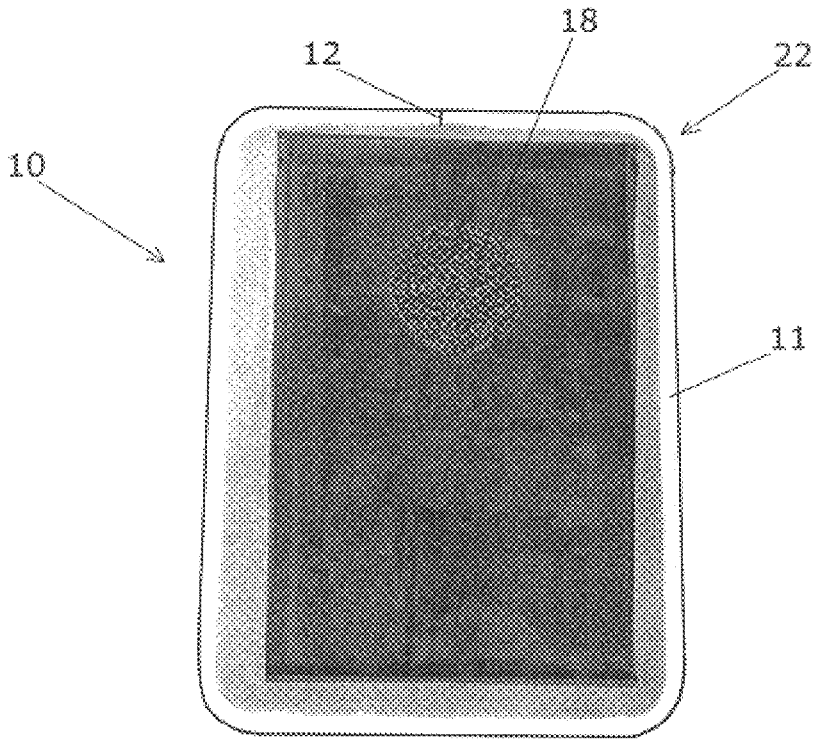
FIG. 3 is a top view of the printing screen frame assembly of the invention.
Figure 4:
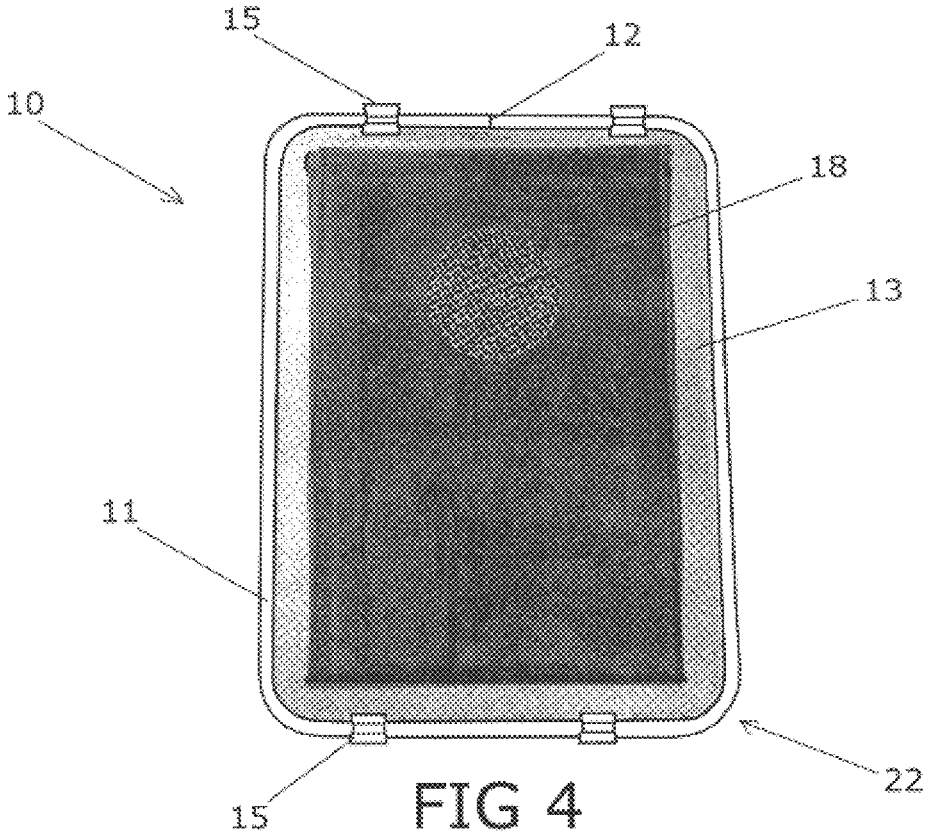
FIG. 4 is a bottom view of the frame assembly of FIG. 3.
Figure 5:
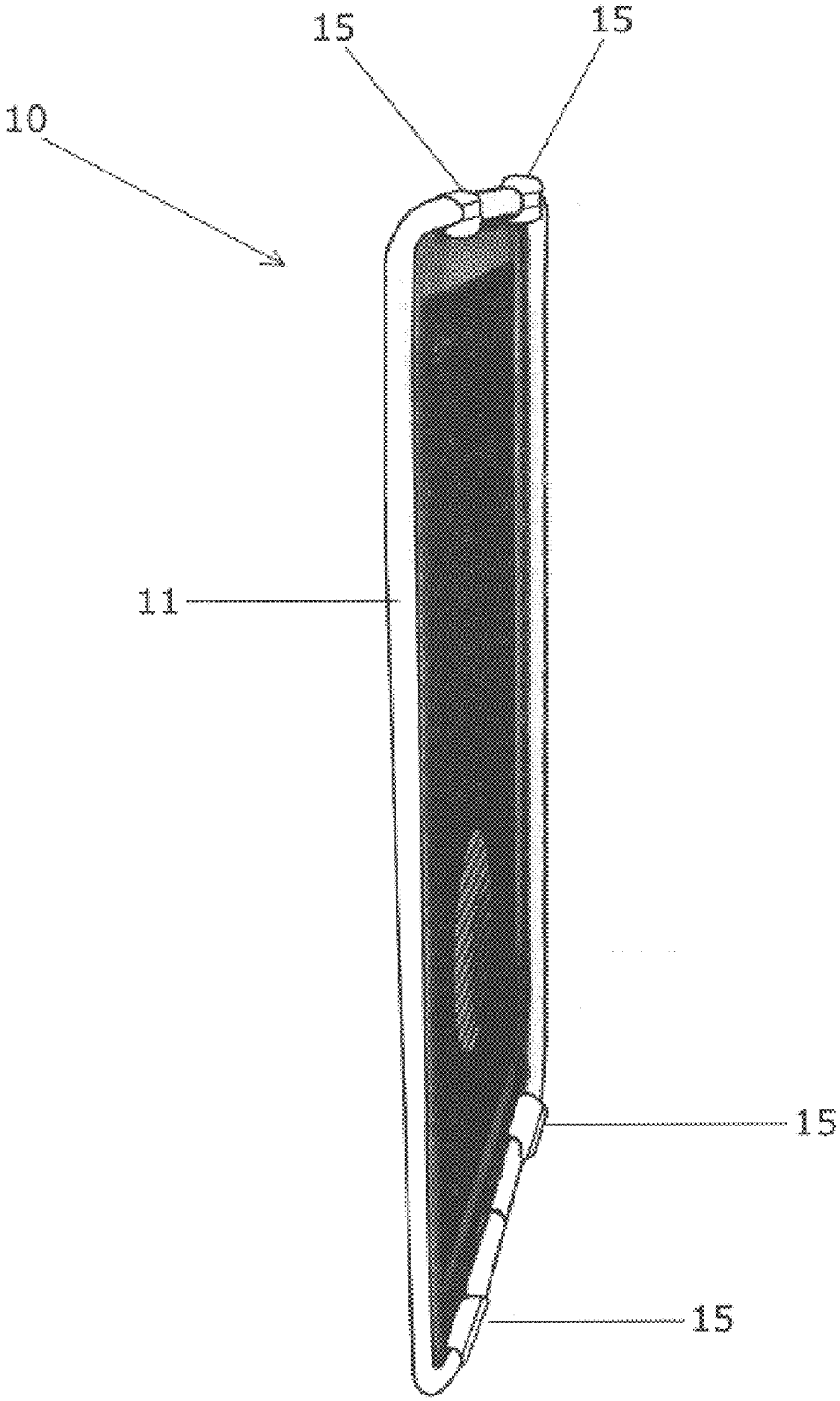
FIG. 5 is a side view of the frame assembly of FIG. 3.
Figure 6:
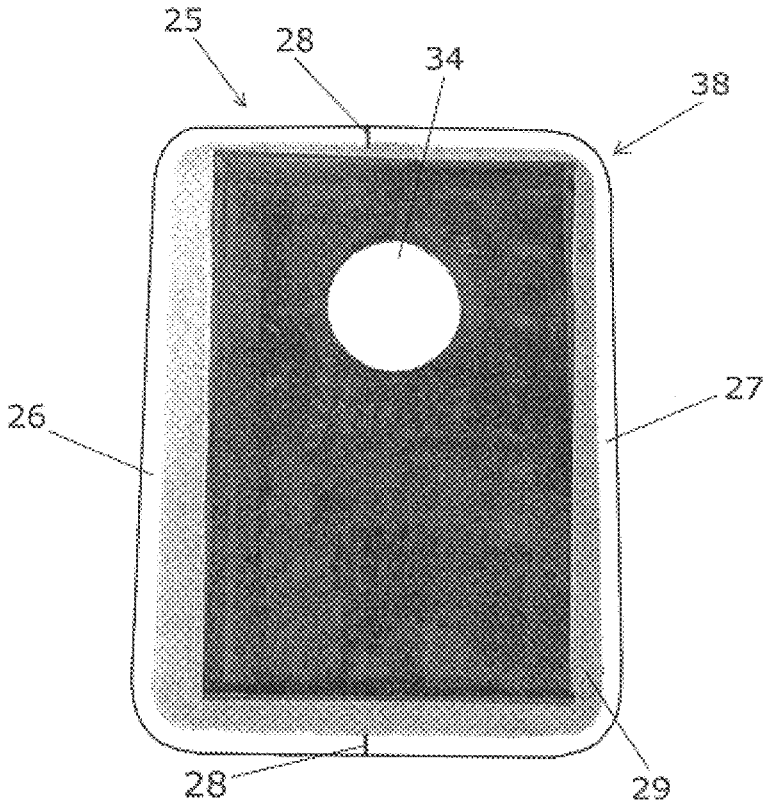
FIG. 6 is a top plan view showing another embodiment of the frame assembly of the present invention.
Figure 7:
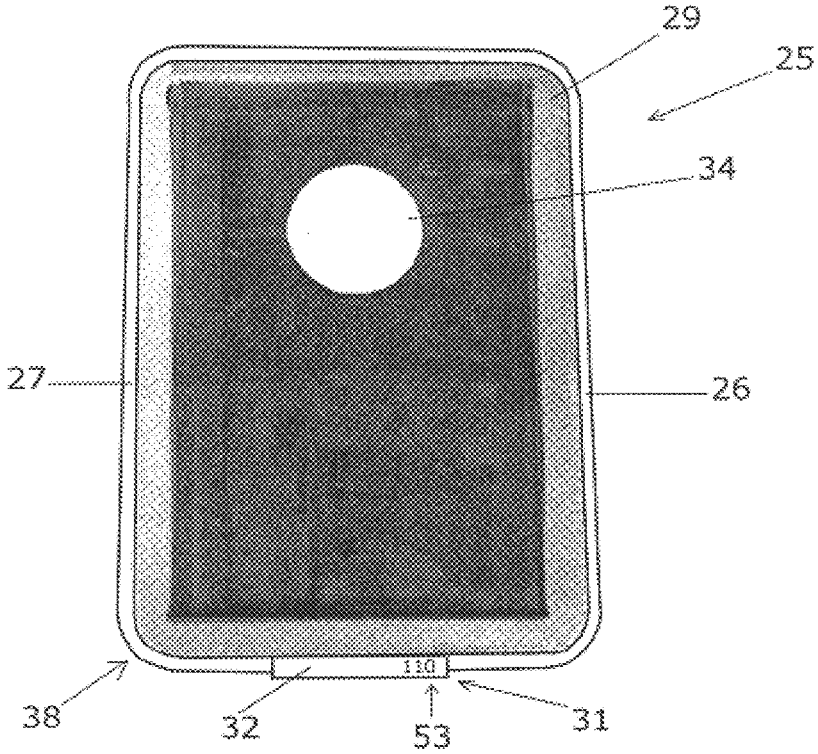
FIG. 7 is a bottom plan view of the frame assembly of FIG. 6.

Attached to the bottom of frame 11 and opposite screen fabric 13 is at least one spacer device. In FIG. 4, four plastic molded spacers 15 are shown attached to the frame 11. FIG. 2 shows a generally C-shaped molded spacer 15. Each spacer body 16 has a generally semicircular cross-section including a rounded inner surface and a flat bottom surface 17. When snapped onto the outer surface of the frame member 11, the spacers 15 remain attached to the frame 11. Four spacers 15 are shown attached to the print screen frame 10, as shown in FIGS. 4 and 5; however, one spacer and other spacer structures may be utilized. The flat edge 17 of the spacers 15 allow the entire frame assembly 10 to be properly installed and used in a printing press and to rest on the floor to permit multiple assemblies 10 to be stacked on top of one another for storage purposes. The spacing between the stacked frames permit the printing screens to dry after use. Preferably, the spacers 15 are coded to properly identify the printing screen frame structures, as shown in FIG. 7 as identifying code 53. For example, various spacer 15 colors are used to identify the mesh count of the fastened screen (i.e., 110, 160 or 230 threads per inch). Possible methods of coding are by wood burning dye, insert, hot stamp, or hot burning dye, but any manner of identification is within the purview of this invention. The molded spacer 15 has a height 20 which is variable to accommodate the necessary dimensions required for the printing press in which the frame 11 is used.

The plastic insert 19, as shown in FIG. 1, can be for example a Schedule 80, ½ inch D PVC conduit or the like which is inserted into the metal conduit ends with a hydraulic press while the frame is clamped. The insert 19 frictionally holds the frame 11 together at seam 12 and yields a strong unitary frame structure. The insert 19 may be 4 inches in length, for example, whereby 2 inches span on either side of the seam 12. Such insert 19 is preferred in a conduit having a 0.922 OD. Other plastic insert diameters are usable with conduits having different outside and inside diameters and wall thickness. As shown, the insert 19 preferably has tapered ends 21 which aid in the insertion of insert 19 by means of a hydraulic press and to ultimately form a tight joint 12.

If a joint 12 is induction welded to form the frame 11, the weld area is preferably protected from corrosion with a galvanized zinc spray paint, or by a galvanized zinc plating process or by a zinc hot dip process. The joint 12 of the frame 11 may also be TIG welded or joined via a resistance welding process. Subsequently, the welded area is preferably coated with a galvanized zinc.

Figure 8:
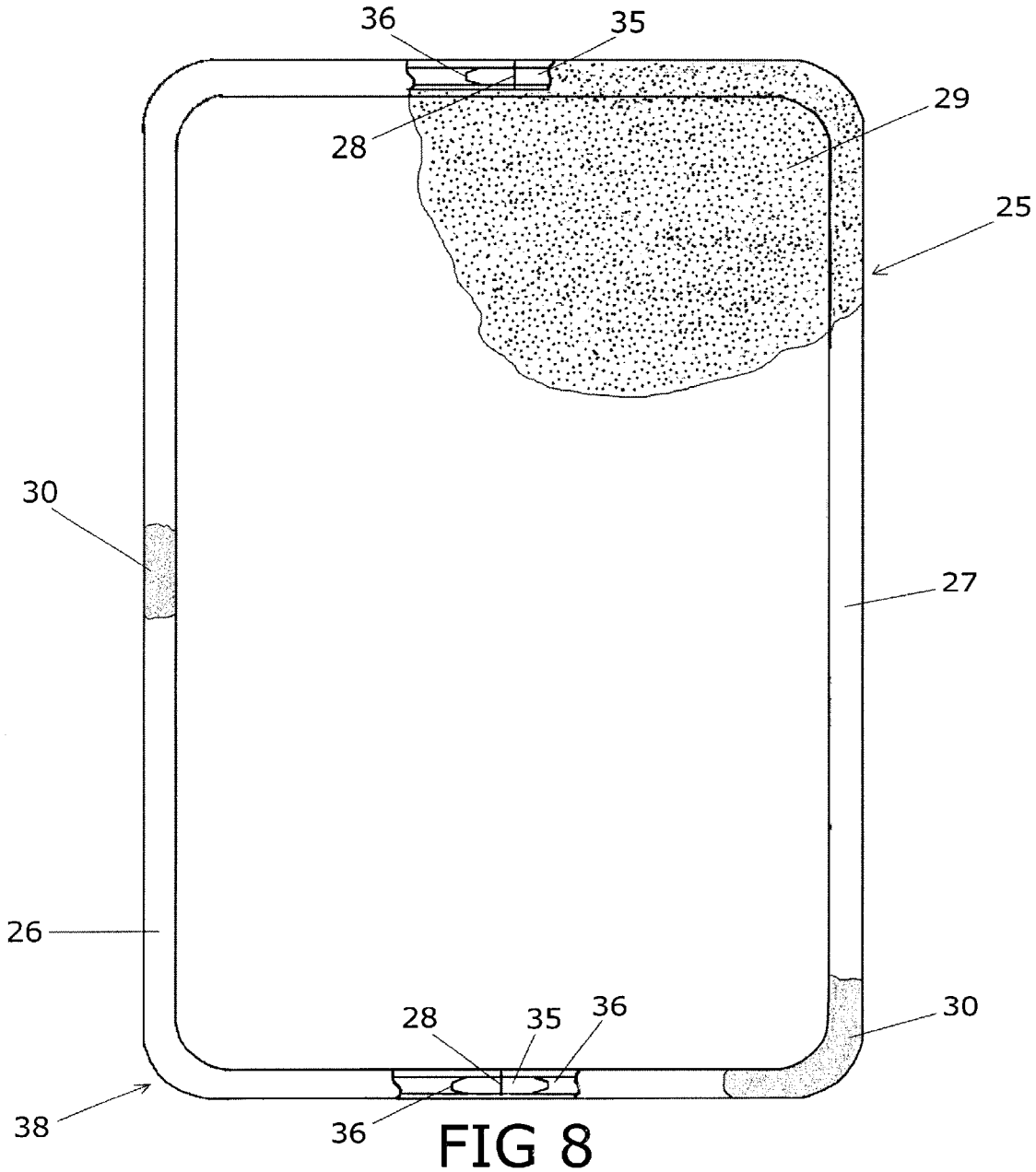
FIG. 8 is a top view showing sectional views of the frame assembly of FIG. 6.
Figure 9:
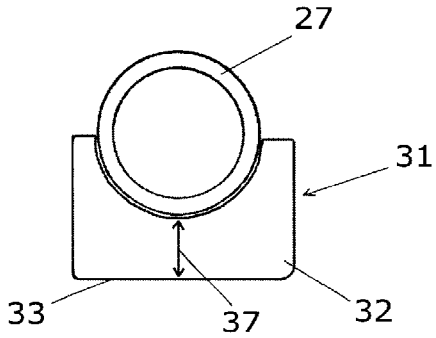
FIG. 9 is a cross-sectional view of the spacer device shown in FIG. 7.

Referring to FIGS. 6–9, another embodiment 25 is shown of the printing frame structure of the present invention. As shown, the frame structure 25 has two frame portions 26 and 27 which are joined at seams or joints 28. As in connection with screen frame structure 10, a screen fabric 29 is adhered in a taut condition using adhesive 30 to the periphery of the frame, namely to frame portions 26 and 27. A print image is shown on screen fabric 29 which includes image 34. The frame structure 25 is further shown to have rounded corners 38. FIG. 7 is a view of the printing screen frame structure 25 and shows spacer 31 attached at one end of the peripheral frame. The spacer 31 is shown to be an elongated structure having a body 32. FIG. 9 further shows spacer device 31 having a flat bottom 33 and height 37. Although the spacer 15 of embodiment 10 is described as being molded of a plastic material, for example, the spacer body 32 is preferably comprised of a wood composition. For example, an elongated spacer, i.e. 12 inches long, comprised of a poplar wood has been found effective and efficient for use in printing press environments. As described above, the spacers are utilized to elevate the printing frame for use in printing presses and are also utilized to store the various printing screen frames by permitting the various frames to be stocked on top of each other.

FIG. 8 shows that the frame portions 26 and 27 are held together by means of inserts 35 which are shown extending into the facing ends of frame portions 26 and 27. As shown, the inserts 35 each have tapered ends 36 which are utilized to force the inserts 35 into the interior of the conduit frame portions 26 and 27.

Preferably, the inserts 35 are comprised of Schedule 80 PVC pipe and which are forced into the conduit interior by means of a hydraulic press. The Schedule 80 PVC pipe has an outside diameter which is slightly greater than the inside diameter dimension of the ¾ inch electrical conduit. During insertion by means of the hydraulic press, the exterior surface of the PVC pipe is slightly shaved off to thereby provide a tight and strong connection between frame portions 26 and 27.

Figure 10:
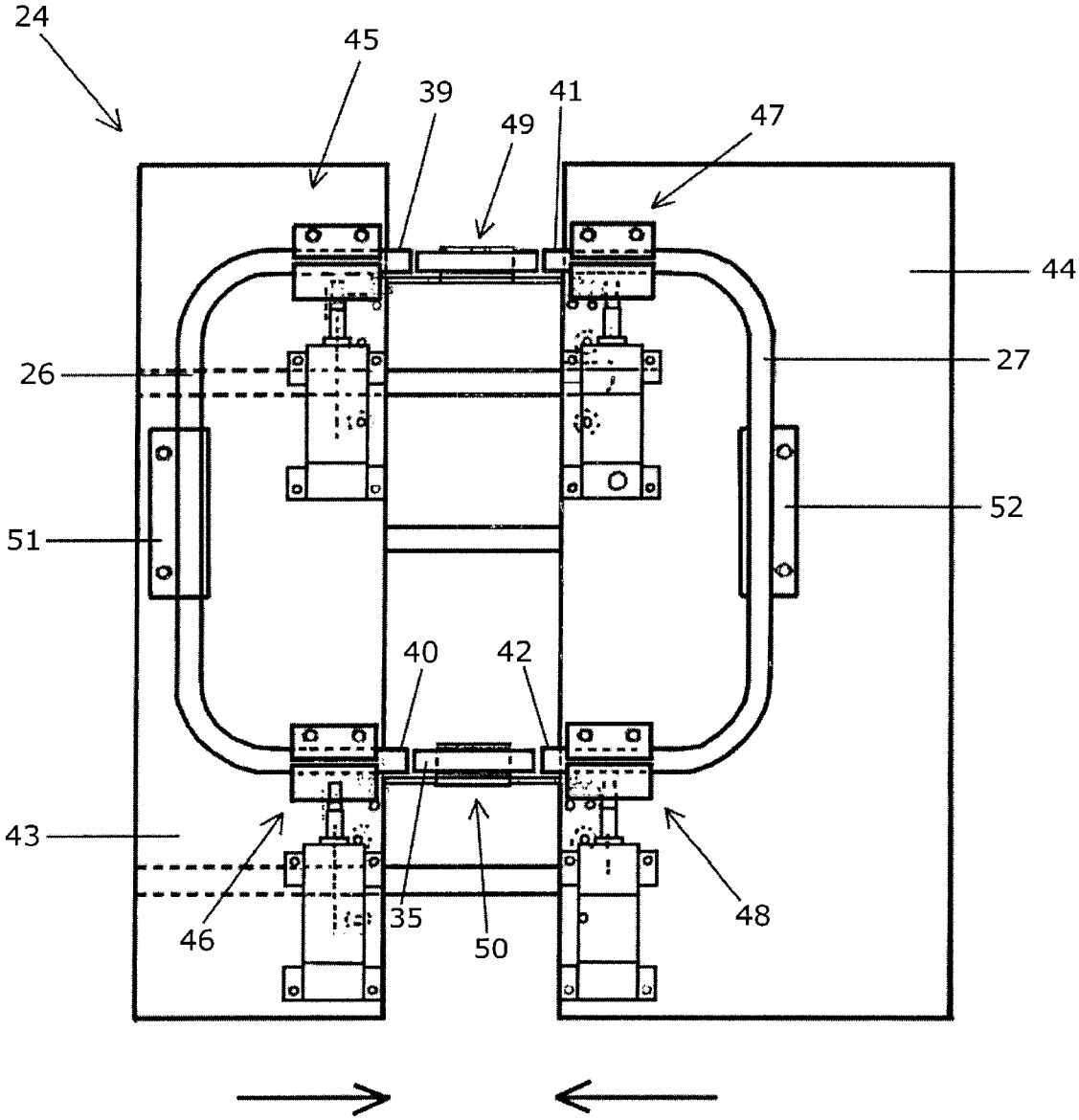
FIG. 10 is a top plan view of a frame making assembly used to practice the method of the present invention.

FIG. 10 shows a frame making assembly 24 which may be used in the method steps of utilizing an electrical conduit to form a screen printing frame. A generally planar work area is shown comprising opposing work portions 43 and 44 which are constructed and arranged to hold and align frame members 26 and 27 and to move the respective ends 39 and 40 of frame member 26 and ends 41 and 42 of frame member 27 towards each other until they meet or abut to form a seam. Clamping devices 45 and 46 are shown holding frame portion 26 and clamping devices 47 and 48 are shown holding frame portion 27. Frame positioning blocks 51 and 52 are shown mounted to work portions 43 and 44 respectively. The positioning blocks 51 and 52 have an interior profile to capture the frame portions 26 and 27. Work portions 43 and 44 are shown via arrows to move towards each other, as by hydraulic means, for example.

Insert holding devices 49 and 50 are shown positioned within the gap of the opposing work portions 43 and 44 and are respectively shown to support inserts 35 in alignment with conduit ends 39 and 41 and conduit ends 40 and 42. As the opposing members 43 and 44 are moved towards each other, by either one or both portions moving inward and thereby reducing the gap, the opposing ends of the frame members 26 and 27 make contact with the tapered ends of the aligned inserts 35 and cause the inserts 35 to be forced into the inside of the respective conduit ends, the holding devices 49 and 50 drop downward or are otherwise moved from the work area and thereby allow the inserts 35 to be imbedded into the respective conduit members 26 and 27. For example, a cam type attachment to or part of the holding devices may be utilized to move the holding devices downward when the opposing conduit members 26 and 27 are brought together. This movement permits the inserts 35 to be completely positioned within the conduit members, as shown in FIG. 8. After the unitary frame structure has been removed from the assembly 24, the work portions 43 and 44 are again separated, and the insert holding devices 49 and 50 move upward and are realigned in the original position for forming another frame member.

In summary, an object of this invention is to provide an affordable and durable frame for textile screen printers. The method of manufacturing the enclosed printing frame assembly utilizes at least one length of electrical conduit, whereby the electrical conduit is bent so that the one or more lengths form a generally planar enclosure. The ends are then aligned and joined and a print screen fabric is stretched over and adhered to the frame. The frame assembly is not intended to be restretched. The frame structure can be comprised of metallic, zinc coated conduit which is resistant to warping and bowing. The frame structure is prestretched with fabric, can have at least one spacer and is adapted for use in textile printing presses.

As many changes are possible to the embodiments of this invention utilizing the techniques thereof, the descriptions above, and the accompanying drawings should be interpreted in the illustrative and not in the limited sense.

That which is claimed is:

1. A method of making a printing screen frame assembly, comprising the steps of:

a) providing at least one length of tubular metal conduit;

b) bending said at least one length of metal conduit to form a rounded angle so that all the ends of the metal conduit axially align to form a closed, generally planar frame structure and thereby forming an opening;

c) joining the ends of the metal conduit to form said frame structure;

d) adhering to the outer surface of the frame structure a taut print screen fabric stretched over said opening formed by said frame structure; and e) attaching at least one coded spacer device having an identifying code thereon to the tubular conduit.

2. The method of making said printing screen frame assembly of claim 1, wherein said at least one spacer device is attached to the metal conduit opposite the adhered print screen fabric, and wherein the metal conduit provided is zinc galvanized, carbon steel.

3. The method of making said printing screen frame assembly of claim 1, wherein each said spacer device has an inner surface that conforms in shape and size to the outer surface of the frame structure and has an outer surface with a flat bottom.

4. The method of making said printing screen frame assembly of claim 3, wherein said identifying code of said at least one spacer device identifies the mesh count of the print screen fabric.

5. The method of making said printing screen frame assembly of claim 1, wherein at least one spacer device is comprised of a plastic or wood.

6. The method of making said printing screen frame assembly of claim 1, wherein the step of joining the ends of the metal conduit is accomplished by pushing approximately half the length of an insert into each of the respective aligned ends of the metal conduit, the insert having an outer diameter so that the insert frictionally fits inside the metal conduit to unitarily join the insert and metal conduit.

7. The method of making said printing screen frame assembly of claim 6, wherein the insert is about 4 inches long and tapered on both ends to more easily align and position the insert within one open end of the metallic conduit.

8. The method of making said printing screen frame assembly of claim 6, wherein the metal conduit provided is ¾ inch metal conduit and the insert is made of Schedule 80 PVC conduit.

9. The method of making said printing screen frame assembly of claim 1, wherein the step of joining ends of the metal conduit uses a welding process selected from the processes of induction welding, TIG welding, and resistance welding, and uses a coating process selected from the processes of painting, plating, and hot dipping to galvanize a seam with a zinc coating.

10. The method of making said printing screen frame assembly of claim 1, wherein the step of adhering the print screen fabric to the frame structure uses a cyanoacrylate adhesive.

11. A method of manufacturing an enclosed printing frame assembly from electrical conduit comprising the steps of:

a) providing at least one length of hollow electrical conduit having open ends;

b) forming a generally planar enclosure utilizing said at least one length of electrical conduit; and c) attaching to said generally planar enclosure a spacer device having a surface spaced from the electrical conduit forming the planar enclosure.

12. The method of manufacturing the enclosed printing frame assembly of claim 11, further comprising the step of joining the ends of the electrical conduit by providing a length of insert material having a specified diameter and aligning and forcing said insert material into the open ends of the electrical conduit to form said enclosed printing frame assembly.

13. The method of claim 12 further comprising the step of utilizing a hydraulic press for forcing said insert material into the open ends of the electrical conduit.

14. The method of claim 11, wherein said at least one length of electrical conduit comprises two lengths of electrical conduit and the method further comprises providing two lengths of insert material and aligning and forcing one insert material into the opposing ends of each said electrical conduit length.

15. The method of claim 11, wherein said method further comprises stretching a fabric and securing the fabric on said frame assembly.

16. The method of claim 15, wherein said spacer device provided is constructed of wood or a plastic composition and wherein said enclosed frame assembly is formed of a generally rectangular configuration with rounded corners.

17. A print screen frame assembly for use in screen printing operations, the print screen frame assembly comprising:

a) a frame having a closed geometric shape defining an opening and constructed of tubular metal conduit;

b) a taut print screen fabric stretched over the opening formed by the frame and adhered to the outer surface of said frame; and c) at least one spacer device attached to said tubular metal conduit, said at least one spacer device having an identifying code.

18. The print screen frame assembly of claim 17, wherein said at least one spacer device is attached to said metal conduit opposite the adhered print screen fabric, each said spacer device having an inner surface that conforms in shape and size to the outer surface of the frame, and wherein the metal conduit is constructed of zinc galvanized, carbon steel.

19. The print screen frame assembly of claim 18, wherein the identifying code on said at least one spacer device comprises information to identify the kind of frame assembly and said at least one spacer device is formed of a plastic composition.

20. The print screen frame assembly of claim 17, wherein the print screen fabric is adhered to the frame by means of a cyanoacrylate adhesive.

21. A method of making a printing screen frame assembly, comprising:

a) providing at least one length of tubular metal conduit;

b) bending said at least one length of metal conduit to form a rounded angle so that all the ends of the metal conduit align to form a closed, generally planar frame;

c) clamping the metal conduit to the tops of leveled working surfaces of a hydraulic press assembly, so that each end of the metal conduit remains axially aligned with another end as the working surfaces are brought together;

d) placing an insert, which insert has an outer diameter so that the insert frictionally fits inside the metal conduit to unitarily join the insert and metal conduit, on top of a support of the hydraulic press so that the insert axially aligns with aligned ends of the metal conduit;

e) joining two aligned ends of the metal conduit by moving the working surfaces together so that the ends of the metal conduit contact each other and the insert is pushed into the ends of the metal conduit;

f) adhering to the outer surface of the frame a taut print screen fabric that is stretched over the opening formed by the frame; and g) attaching at least one spacer to the metal conduit opposite the adhered print screen fabric.

22. A print screen frame assembly for use in screen printing operations, the print screen frame assembly comprising:

a) at least one length of tubular electrical conduit;

b) means of securing said at least one length of tubular electrical conduit in a closed generally planar geometric shape, thereby forming a frame structure having an inner opening; and c) a spacer device attached to said frame structure, said spacer device having a body, a thickness and a flat surface, said flat surface being spaced from said tubular electrical conduit.

23. The print screen frame assembly of claim 22, wherein said at least one length of tubular electrical conduit has open ends and wherein said means of securing said at least one length of tubular electrical conduit is a tapered insert pushed into the open ends of said at least one length of tubular conduit.

24. The print screen frame assembly of claim 22, wherein a taut print screen fabric is stretched and secured over said inner opening of said frame structure.

25. The print screen frame assembly of claim 24, wherein said spacer device body has an identifying code to identify the mesh count of said print screen fabric and wherein said flat surface is generally spacially parallel to said print screen fabric.

* * * * *